United States Patent [19]

Cote

[11] Patent Number: 5,042,456

[45] Date of Patent: Aug. 27, 1991

[54] AIR CANOPY VENTILATION SYSTEM

[76] Inventor: Cameron Cote, 1047 MacKid Road N.W., Calgary, Alberta, Canada, T2E 6A8

[21] Appl. No.: 530,746

[22] Filed: May 30, 1990

[51] Int. Cl.[5] ..... F24C 15/20

[52] U.S. Cl. ..... 126/299 D; 98/36; 98/115.3

[58] Field of Search ..... 126/299 R, 299 D; 98/36, 115.1, 115.3

[56] References Cited

U.S. PATENT DOCUMENTS

| | | | |
|---|---|---|---|
| 2,544,769 | 3/1951 | Sperry et al. | 98/115.1 |
| 2,794,514 | 6/1957 | Risley | 126/299 D X |
| 3,021,776 | 2/1962 | Kennedy | 98/115.3 |
| 3,131,687 | 5/1964 | Kalla | 126/299 D |
| 3,260,189 | 7/1966 | Jensen | 126/299 D |
| 3,292,525 | 12/1966 | Jensen | 126/299 D |
| 3,303,839 | 2/1967 | Tavan | 126/299 D |
| 3,358,579 | 12/1967 | Hauville | 98/115.3 |
| 3,386,365 | 6/1968 | Jensen | 98/36 |
| 3,387,551 | 6/1968 | Hughes | 98/36 X |
| 3,425,335 | 2/1969 | Black | 98/115.3 |
| 3,585,919 | 6/1971 | Culpepper, Jr. | 98/36 |
| 3,785,124 | 1/1974 | Gaylord | 126/299 D X |
| 4,050,368 | 9/1977 | Eakes | 98/115.3 |
| 4,467,782 | 8/1984 | Russell | 126/299 D |
| 4,902,316 | 2/1990 | Giles, Sr. et al. | 126/299 D X |

FOREIGN PATENT DOCUMENTS

| | | | |
|---|---|---|---|
| 833886 | 2/1970 | Canada . | |
| 1045885 | 1/1979 | Canada . | |
| 197803 | 3/1978 | Fed. Rep. of Germany | 126/299 D |
| 2308872 | 11/1976 | France | 98/36 |

*Primary Examiner*—Harold Joyce

*Attorney, Agent, or Firm*—Bean, Kauffman & Spencer

[57] ABSTRACT

An air canopy ventilation system is disclosed which comprises a surface having two substantially parallel spaced apart side walls surmounted at their respective upper edges by a canopy. A vent means having a plurality of outlets extends between the side walls and substantially the whole length of the front edge of the surface. A fan means connected to the vent means is adapted to drive a flow of air through the vent means upwardly to form a curtain of air over the front of the system, thereby entraining within the area fumes and odors. The upwardly flowing air, fumes and odors are removed by an exhaust means. The exhaust means can include a filter means and a return air means. The system has applications in commercial cooking systems, laboratories, and areas requiring removal of fumes and gases from an enclosed working surface.

20 Claims, 4 Drawing Sheets

AIR CANOPY VENTILATION SYSTEM

FIELD OF THE INVENTION

This invention relates to canopy venting systems, and more particularly to canopy venting systems suitable for use in controlling and containing noxious and undesirable fumes in such areas as above cooking surfaces, in laboratories and other similar situations.

DESCRIPTION OF THE RELATED ART

Systems for use in laboratories, and over cooking surfaces, including commercial installations and kitchen stoves, for the removal of fumes are known in which an exhaust vent powered by a suction fan and located in a canopy above the surface draws fumes upwards from the area of the surface to a stack which is vented to the exterior of the room or building. Such systems may be combined with a venting means intended to provide for a curtain of down flowing air from the front of the canopy to decrease the air and fume flow into the room. In application to cooking systems, such systems are designed to be mounted on a wall above the stove cooking surface, with considerable clearance therefrom, or to be integrally constructed with the stove, but nevertheless with the same clearance.

For example, Canadian Patent No. 833,886 discloses a ventilating hood structure for removing fumes from a source located near the hood, including creating a low pressure zone near the source of fumes and partially surrounding it with a supply of air under pressure, so as to entrain the fumes which are thereafter removed from the zone by an exhaust fan which creates the low pressure zone.

Canadian Patent No. 1,045,885 describes a kitchen ventilator including a housing to be mounted above a kitchen stove, and including means for producing a downwardly flowing air curtain to restrain odors and fumes produced by cooking on the stove.

U.S. Pat. No. 4,050,368 (Eakes) discloses an industrial style exhaust system which uses an air curtain to trap contaminated air and remove it. U.S. Pat. No. 3,021,776 (Kennedy) discloses a laboratory fume hood using different velocities of side moving air to trap fumes and remove them. The use of this type of system has been banned in some areas. U.S. Pat. No. 3,131,687 (Kalla) describes an air curtain type of ventilating system that uses directed air to move contaminated air and is directed towards home stove units. U.S. Pat. Nos. 3,425,335 (Black) and 3,358,579 (Hauville) disclose laboratory fume hoods that exhaust contaminated air to the outside. U.S. Pat. No. 3,303,839 (Tavan) describes a portable vertical air curtain device that exhausts the contaminated air along with large volumes of room air.

Such systems have several disadvantages, including the use of large quantities of room air for their operation, which heated air passes to the outside of the building, with consequent increase in energy costs. There is also a fire risk from the duct work carrying the heated air, and increased costs associated with minimizing such risk. A further disadvantage lies in the fact that such systems are not designed to clean the fumed air prior to exit by the exhaust, so that any air which escapes the system, rather than passing out of the building, will retain the fumes and contaminate the room air. Still further disadvantages lie in the space required to install such systems, creating problems of requiring reconstruction or rearrangement in the vicinity of the stove or cooking unit, particularly to ensure the necessary clearance between the system and the cooking surface. The known systems can therefore be difficult and costly to install.

SUMMARY OF THE INVENTION

An object of the present invention is to provide a system which is compact and simple to manufacture and install, does not require exhaust to the exterior of the building, although such can be optional, uses a minimum of room air and is energy efficient in recirculating air, with little or no contamination of the room air.

Accordingly, the invention provides a canopy system for cooking equipment comprising two mutually substantially parallel side walls and a rear wall extending upwardly from each side and the rear of a cooking surface and surmounted by an upper canopy, vent means adjacent to and extending substantially the whole length of a front edge of said cooking surface, means connected to and adapted for driving a flow of air through said vent means upwardly towards said upper canopy so as to form in use an upwardly directed air curtain, said upper canopy including exhaust means centrally located therein and disposed laterally inwardly from the plane of said air curtain for continuously exhausting the upper portion of said air curtain together with cooking fumes generated during operation of said cooking surface, the lower portion of each of said side walls including duct means for the supply of a supplementary air flow to assist in directing air away from the side edges of said upwardly directed air curtain and improving the integrity of said air curtain, and means for driving a supplementary flow of air through said duct means.

The cover optionally incorporates therein an ecologizer filter unit and a suction motor with a return air means for returning cleansed air to the vent means and room.

BRIEF DESCRIPTION OF THE DRAWINGS

The invention will be better understood by the following detailed description of embodiments thereof with reference to the accompanying drawings, in which.

DESCRIPTION OF THE PREFERRED EMBODIMENTS

Figure 1:
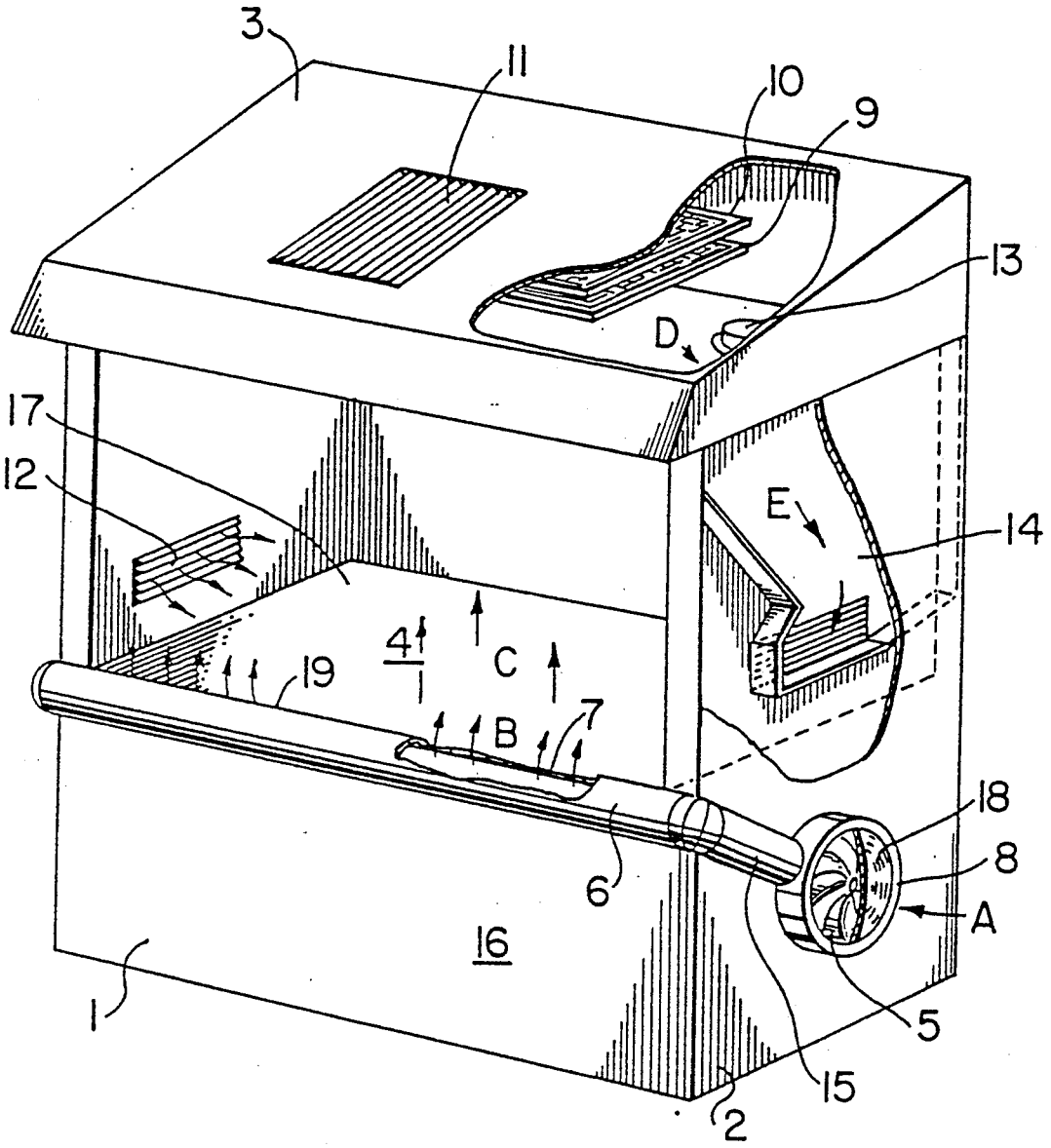
FIG. 1 shows an isometric, partially cut away front corner view of a canopy system of an embodiment of the invention.
Figure 2A:
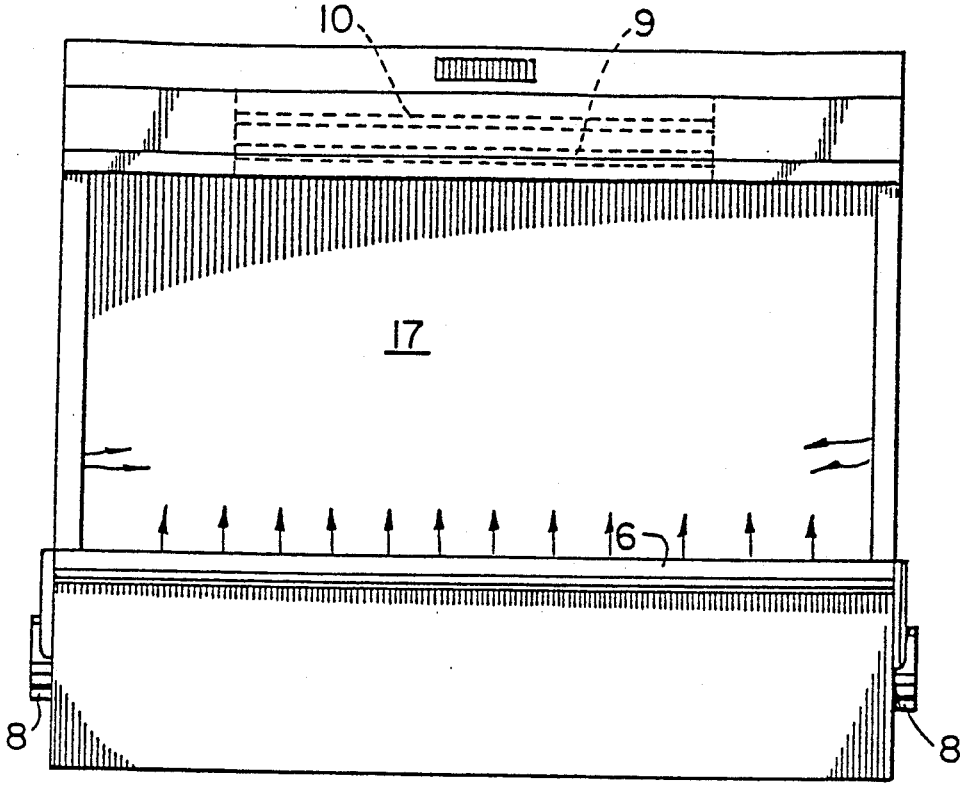
FIGS. 2A and 2B are side and end views of the canopy system of FIG. 1.
Figure 2B:
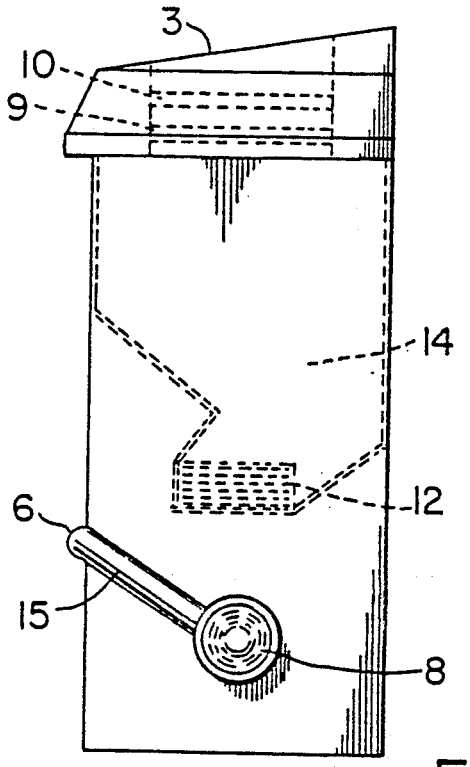

Referring to FIGS. 1, 2*a* and 2*b*, the system comprises a housing 1 having a cooking surface 4, side of the housing 1 comprises an opening 17, whereas the lower portion 16 is enclosed. At the upper edge of the enclosed front portion 16 is a longitudinally extending vent 6 positioned at adjacent front edge 7 of the cooking surface 4. The vent 6 extends across the entire width of the front edge 7, between the side walls 2. A plurality of air outlets 19 are provided along the length of the vent 6.

Mounted on one or both side walls 2 and communicating via duct 15 with one or both ends of the vent 6 is a fan motor 5 within a fan housing 8, including air inlet ports 18, for the intake of room air. A return air channel 14 extending from the canopy 3 passes within or adjacent to each side wall 2, and communicates with in-flow vents 12 located on the inside of the side walls 2 above the cooking surface 4.

The canopy 3 has incorporated therein a primary filter 9 and a secondary filter 10, the latter filter comprising in this embodiment an ecologizer unit. Above the unit 10, and within the upper surface of the canopy 3, a room vent 11 is located to permit the escape of excess air to the room. One or more suction motors 13 are also provided within the canopy 3.

In an alternative embodiment, an exit stack is disposed above the secondary filter 10 and leads to the exterior of the building. In this case the room vent 11 is omitted.

The operation of the system will now be described.

Air from the room is drawn through the air inlet ports 18 in the direction of arrow A by means of the fan motor 5 within the fan housing 8, and forced into the vent 6. The air passes through the vent 6 and then upwards from outlets 19 along the length of the vent 6 to form a vertical curtain of "clean" air in the opening 17 of the housing 1.

The air is drawn upwards in the direction of the arrow B by the suction motor 13 within the canopy 3, and draws with it the fumed air from the cooking surface 4, in the direction of the arrow C. The fumed air passes through the primary filter 9, and into the ecologizer unit filter 10. From the secondary filter 10, the cleansed air is further drawn by the suction motor 13 into the return channel 14 in the direction of the arrow D, and thence in the direction of the arrow E to pass through the vents 12 into the cooking space above the cooking surface 4.

The air within the system is thus subject to a continuous recirculation process, which minimizes heat and energy loss, and minimizes the use of room air and the necessity of heating the same. The system is compact and simple to manufacture and install, and requires less clearance than traditional exhaust systems. The upward flow of air from the vent 6 follows the normal rising path of the fumed air from the cooking surface 4, so that the fumed air is more readily carried upward into the filters 9 and 10 than would occur with a system providing an air curtain with a downward flow from an upper canopy unit. The addition of room vent 11 and in-flow vents 12 allows for additional air flow where required. All air leaving the system by room vent 11 to pass into the room will have been cleansed by the filters 9 and 10. The contamination of the room air by fumed air is thus minimized.

If it is desired to include a traditional exhaust means to the exterior of the building, such can readily be provided by the use of an exhaust stack (not shown) extending from the top of the canopy 3. The cleansed or partially filtered air thus passes from the filters 9 and 10 into such a stack, instead of through return channel 14. This might be desired in the case of particularly excessive contaminating fumes, but the method for normal use would be as described above in relation to the embodiment of FIG. 1.

Figure 3:
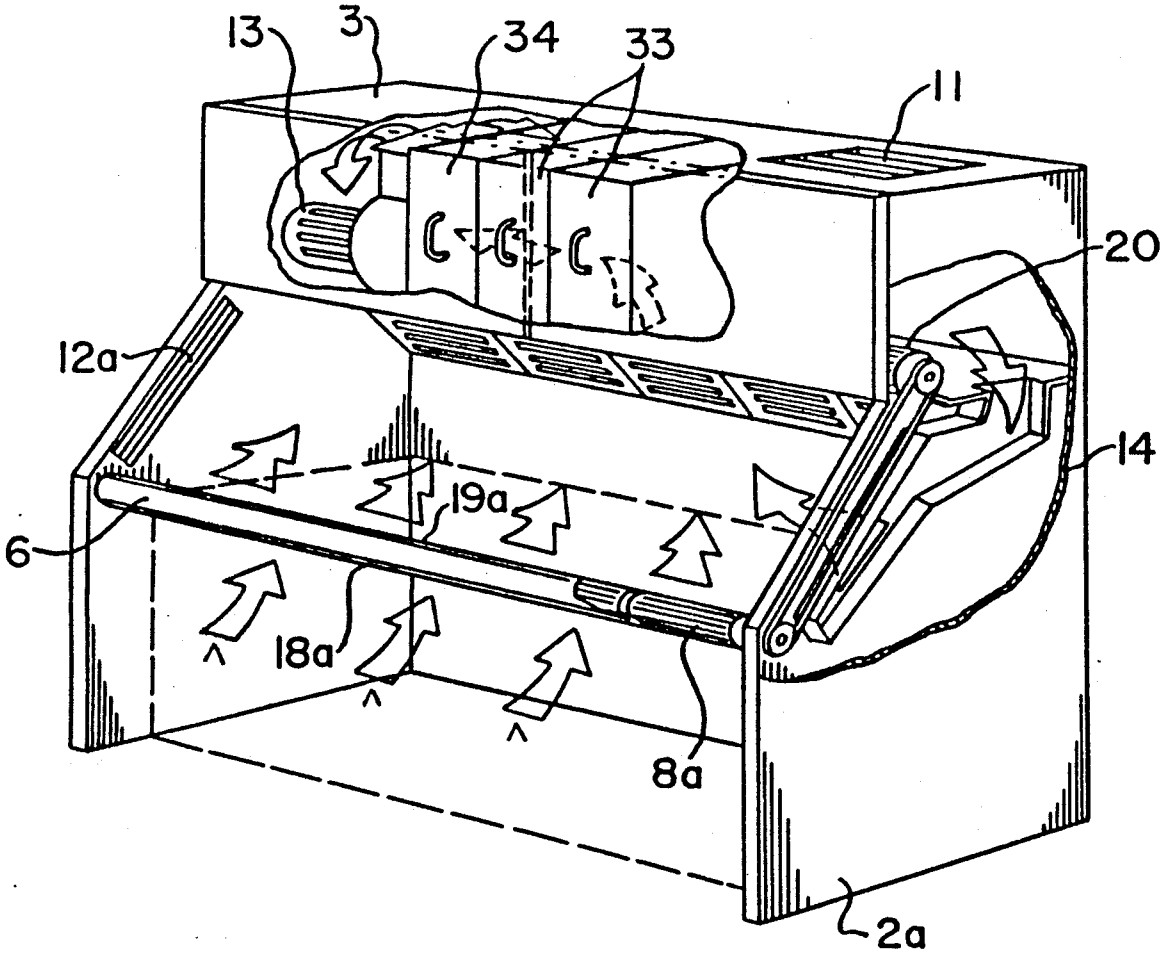
FIG. 3 shows an isometric, partially cut away front corner view of a canopy system of a preferred embodiment of the current invention.

In an alternative embodiment, shown in FIG. 3, the upwardly directed air curtain may be directed not only upwards, but inwardly at the same time. In this embodiment, clean room air A is drawn from below and in front of the cooking surface, through air inlet ports 18*a*, by fan means 8*a*, and directed upwardly and inwardly by means of air outlets 19*a*. Side vents 12*a* again assist in maintaining integrity of the upwardly and inwardly flowing air curtain with respect to the backward sloping side walls 2*a*. One of the distinct advantages in this embodiment is that the overhead portion of the canopy may be lowered, thereby increasing the amount of space directly over the canopy, and further, the operater may now lean forward comfortably without contacting the airscreen with their face.

Figure 4:
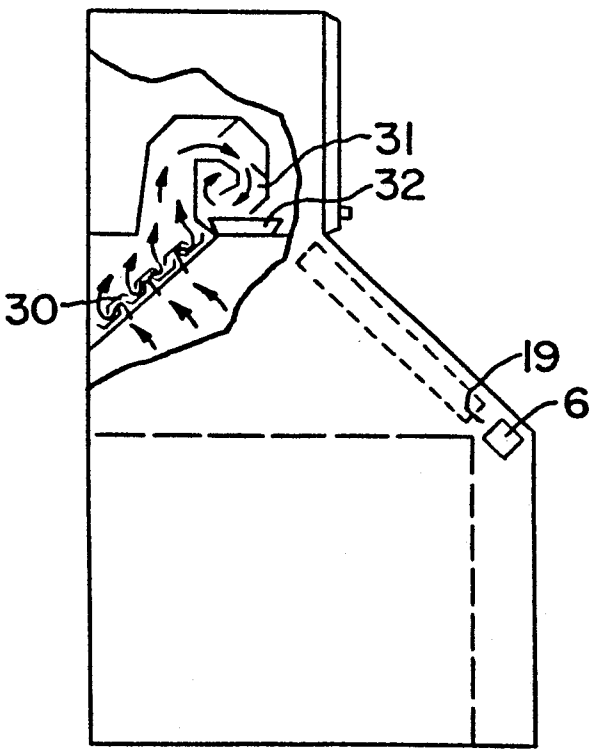
FIG. 4 is a cut away end view of the canopy system of FIG. 4, showing a prefiltration unit disposed in a preferred embodiment.

FIG. 4 shows a cross-section of the first and second stage grease trapping filters in a yet further embodiment. In this embodiment, primary filter 30 is of the baffle or mesh type known in the art. Air is pulled through this filter and towards the secondary stage filter 31. Secondary filter 31 operates by forcing the air stream to rapidly change directions several times. The heavier grease particles are thrown from the airstream by means of centrifugal force and land on the air direction plates of the secondary filter. The grease them runs down the airstream plates to a retaining dish 32 where it is removed during regularly scheduled cleaning. Thus, the primary grease filters provide a method of removing the bulk of the grease from the airstream in a non-disposable type filter. The airstream leaves the secondary filter 31 tangentially to its direction of entrance (i.e., vertical to the page) where it is drawn through tertiary 33 and quaternary 34 stage filters. The tertiary stage filter 33 is composed of two or more glass-fibre filters of progressively finer mesh size. These may be similar to the type commonly used in home filtering systems. This unit, referred to herein as the ecologizer unit requires, replenishment at regular intervals, by disposing of the filters and installing new, clean filters. At this point, virtually all grease and a substantial portion of the smoke have-been removed from the airstream.

Quaternary filter 34 is of an activated charcoal type and serves primarily to remove odors and any residual smoke and grease. Alternatively, a chemical deodorizer of either pellet or liquid type may be employed inplace of the activated charcoal. This filter is also of the disposable type.

After being drawn through the four filtering stages, the airstream is divided. Approximately 70% of the airstream is released through the upper vent means 11 to the room air.

The remaining 30% is directed by means of ducting to the side vents 12A, and also to the air curtain vent means 6 after being mixed with fresh room air provided by fan 8*a*.

In this embodiment, vent means 6 is a square or rectangular tube, with one face perpendicular to the desired direction of the air curtain. Vent openings 19 are in the form of semicircular opening disposed adjacent to each other down the length of vent means 6. The semi-circular openings 19 have the flat of the opening directed towards the bottom , the curved portion directed to the top, and are located in the vertical center of the face of the vent 6 occurring perpendicular to the airstream.

Figure 5:
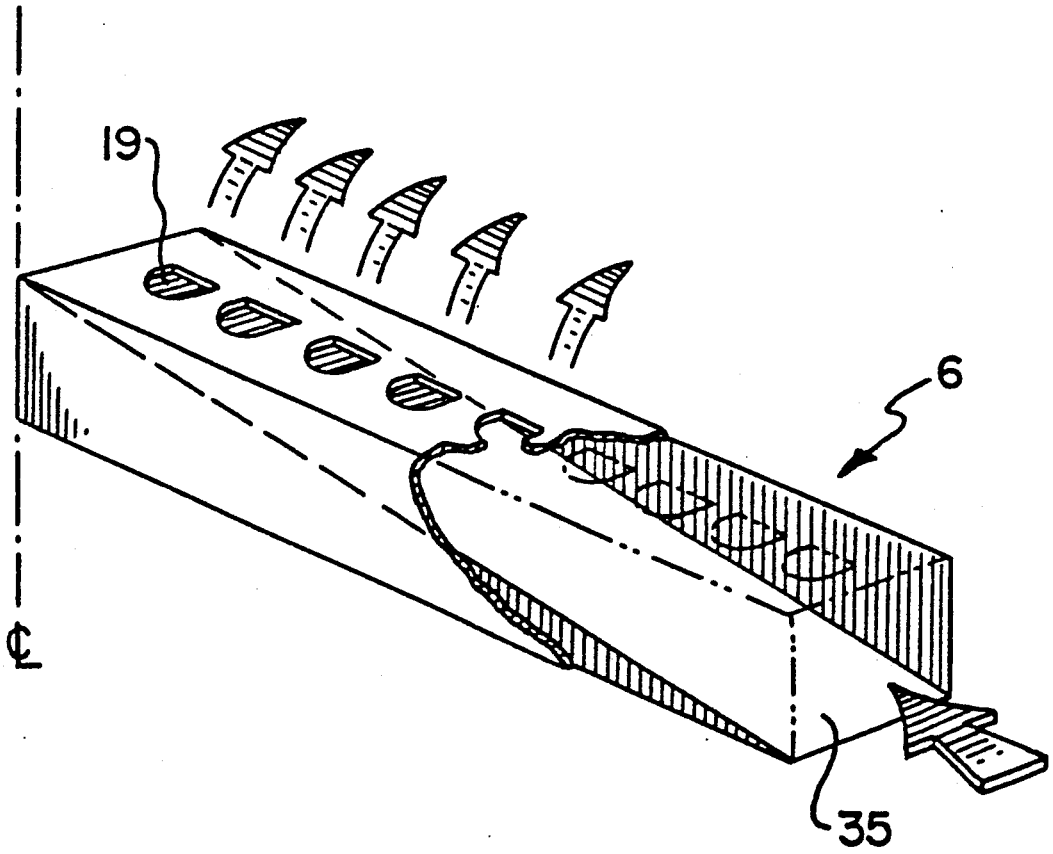
FIG. 5 is a cutaway view of a preferred embodiment of generating the air curtain of the current invention.

FIG. 5 shows a cutaway view of the right-hand half of the vent means 6 with the centerline representing the approximate midpoint of the tube length. Located directly behind the vent openings 19, is a tube volume reduction means 35. The tube volume reduction means 35 is comprised of a strip of metal or other resistant material that extends the height of the tube. Starting at the right-hand end of the square tube where it is attached to the tube wall opposite the tube wall bearing the vent openings 19, the tube volume reduction means progressively narrows the tube width until such time as reaching the midpoint. At the midpoint of the tube, the volume reduction means 35 is attached to the wall bearing the vent opening means 19, having traversed the width of the tube. The tube volume reduction means 35 reduces the volume of the tube so as to compensate for the reduced volume of air remaining, as the airstream progresses inwardly from the ends of the tubes. This allows the air pressure forming the center of the air curtain to be substantially the same as that forming the outside edges, permitting an air curtain of constant strength across the overall width of the air curtain. The tube volume reduction means may be mirror imaged from the centerline of the vent means 6 to produce the left-hand tube volume reduction means. In an alternative embodiment, the tube volume reduction means may begin at one end of the tube and progress through to the other end of the tube in an uninterrupted fashion.

The tube reduction means 35 may have disposed at the ends where the airstream first impinges upon it, raised portions so as to induce at this point turbulence leading to a somewhat increased flow of air through the first couple of vent openings 19, to compensate for the air stream velocity at these points.

It will be readily apparent to those skilled in the art that many improvements and modifications may be made without departing from the essence of the invention.

I claim:

1. A canopy system for cooking equipment comprising two mutually substantially parallel side walls and a rear wall extending upwardly from each side and the rear of a cooking surface and surmounted by an upper canopy, vent means adjacent to and extending substantially the whole length of a front edge of said cooking surface, means connected to and adapted for driving a flow of air through said vent means upwardly towards said upper canopy so as to form in use an upwardly directed air curtain, said upper canopy including exhaust means centrally located therein and disposed laterally inwardly from the plane of said air curtain for continuously exhausting the upper portion of said air curtain together with cooking fumes generated during operation of said cooking surface, the lower portion of each of said side walls including duct means for the supply of a supplementary air flow to assist in directing air away from the side edges of said upwardly directed air curtain and improving the integrity of said air curtain, and means for driving a supplementary flow of air through said duct means.

2. A canopy system as claimed in claim wherein said exhaust means includes a filter means.

3. A canopy system as claimed in claim 1, wherein said exhaust means includes a motor driven suction fan, a filter means and a return air means connected with said duct means.

4. A canopy system as claimed in claim 2, wherein said filter means comprises an ecologizer filter system.

5. A canopy system as claimed in claim 3, wherein said filter means comprises an ecologizer filter system.

6. A canopy system as claimed in claim 1, wherein said means connected to said vent means draws clean air from the exterior of said canopy system.

7. A canopy system as claimed in claim 1, wherein said vent means includes one or more outlets disposed so that, in use, said flow of air forms a substantially vertical air curtain.

8. A canopy system as claimed in claim 1, wherein said vent means is oriented so that the passage of a flow of air therethrough forms an air curtain which is simultaneously directed upward and inward.

9. A canopy system as claimed in claim 8, wherein said vent means comprises a square or rectangular tube oriented in such fashion that one face is perpendicular to said upwardly and inwardly directed air curtain, and wherein said square tube has disposed along the length of said perpendicular face, semi-circular openings for forming said upward and inward directed air curtain.

10. A canopy system as claimed in claim 9, wherein the semi-circular openings are centered in the middle of said perpendicular face and wherein the circular portion of each semi-circle is upwardly directed.

11. A canopy system as claimed in claim 9 wherein the cross-sectional area of said square or rectangular tube progressively decreases inwardly from each end thereof to the middle, and wherein said cross-sectional area is reduced substantially to zero at the longitudinal midpoint of said tube.

12. A canopy system as claimed in claim 11, wherein the cross-sectional area of said square or rectangular tube decreases linearly from one end to the other in an uninterrupted fashion.

13. A canopy system as claimed in claim 4, wherein said ecologizer system is comprised of two or more air filters of progressively finer mesh and an activated charcoal filter or chemical deodorizer.

14. A canopy system as claimed in claim 5 wherein said ecologizer system is comprised of two or more air filters of progressively finer mesh and an activated charcoal filter or chemical deodorizer.

15. A canopy system as claimed in claim 2, wherein a portion of the filter means is comprised of a centrifugal-type air stream degreaser having an inlet port and an outlet port and wherein said outlet port is perpendicular to said inlet port.

16. A canopy system for equipment tending to create fumes during use and having a front, rear opposite sides, said system comprising in combination: opposite side and rear walls arranged to extend upwardly from adjacent said opposite sides and rear of said equipment, an upper canopy surmounting said opposite side and rear walls, air curtain producing means disposed to extend along said front of said equipment intermediate said side walls and cooperating with said upper canopy and said side walls to define an opening, said upper canopy having a front arranged horizontally between said air curtain producing means and said rear wall, said air curtain producing means being adapted to direct an air curtain upwardly towards said upper canopy rearwardly of said front thereof, exhaust means arranged to draw fumes into said upper canopy from adjacent said rear wall, and each of said side walls having vents extending vertically and rearwardly along opposite edges of said opening for introducing air adjacent opposite vertically extending edges of said air curtain.

17. A canopy system according to claim 16, wherein said exhaust means includes a first filter extending vertically and forwardly between said rear wall and said upper canopy.

18. A canopy system according to claim 17, wherein said exhaust means additionally includes a second filter for applying centrifugal force to said fumes passing through said first filter.

19. A canopy system according to claim 18, wherein said exhaust means includes a replaceable third filter, a replaceable fourth deodorizing filter, and a suction means for drawing fumes successively through said first, second, third and fourth filters.

20. A canopy system according to claim 16, wherein said exhaust means includes filter means and suction means for drawing fumes through said filter means and duct means are provided for directing flow from said suction means to said vents of said side walls, and vent means are provided for directing flow from said suction means to said area adjacent said equipment.

* * * * *

UNITED STATES PATENT AND TRADEMARK OFFICE

CERTIFICATE OF CORRECTION

PATENT NO. : 5,042,456

DATED : August 27, 1991

INVENTOR(S) : Cameron Cote

It is certified that error appears in the above-identified patent and that said Letters Patent is hereby corrected as shown below:

Col. 2, line 63 - after "side", insert ---walls 2 and a canopy 3. The upper portion of the front---.

Col. 5, line 59 - after "claim", insert ---1,---.

Col. 6, line 47 - after "rear", insert ---and---.

Signed and Sealed this

Seventh Day of September, 1993

Bruce Lehman

*Attest:*

BRUCE LEHMAN

*Attesting Officer*

*Commissioner of Patents and Trademarks*